US006003466A

United States Patent [19]

Dove et al.

[11] Patent Number: 6,003,466

[45] Date of Patent: Dec. 21, 1999

[54] ANCHOR INSTALLATION VESSEL AND METHOD

[75] Inventors: Peter George Scott Dove, Magnolia; Johannes Jacobus Treu, Bellville, both of Tex.

[73] Assignee: Aker Marine Contractors, Inc., Houston, Tex.

[21] Appl. No.: 09/018,877

[22] Filed: Feb. 5, 1998

[51] Int. Cl.[6] ..... B63B 21/50

[52] U.S. Cl. ..... 114/293; 114/230.2

[58] Field of Search ..... 114/293, 294, 114/221 R, 230, 230.2, 230.22, 230.23

[56] References Cited

U.S. PATENT DOCUMENTS 3,974,793 8/1976 Aring ..... 114/210

5,062,376 11/1991 Tremblay ..... 114/230

FOREIGN PATENT DOCUMENTS 329062 4/1972 U.S.S.R. ..... 114/179

438575 1/1975 U.S.S.R. ..... 114/293

*Primary Examiner*—Ed Swinehart

*Attorney, Agent, or Firm*—Gardere & Wynne, L.L.P.; Daniel F. Perez; Lawrence R. Youst

[57] ABSTRACT

An anchor installation vessel transports anchors and mooring lines to an installation site and installs the anchors at diametrically opposed points in an anchor array. Following installation the mooring lines are directed to the vessel from opposite sides and are preloaded using winches mounted on the vessel.

9 Claims, 5 Drawing Sheets

ANCHOR INSTALLATION VESSEL AND METHOD

TECHNICAL FIELD

This invention relates generally to anchor installation, and more particularly to a vessel adapted for the installation of an array of anchors comprising a preset mooring system and to a method of anchor installation.

BACKGROUND AND SUMMARY OF THE INVENTION

As the exploration for oil and gas expands ever further offshore, it is necessary to moor mobile offshore drilling units (MODU's) and floating production platforms (FPP's) in very deep waters. In many circumstances it is advantageous to moor MODU's and FPP's using preset mooring systems. A preset mooring system typically comprises an array of eight or more anchors each having a mooring line extending therefrom. The array of anchors is installed around a mooring location after which an MODU or a FPP is positioned at the mooring location and is moored utilizing the anchors and the mooring lines of the preset mooring system.

In order to avoid costly delays and reworking operations, the holding power of each anchor in an anchor array of a preset mooring system is carefully tested prior to the connection of an MODU or an FPP to the anchor. Heretofore various techniques have been utilized in anchor testing procedures. These include: use of the anchor installation ship to apply load to a single anchor up to the power limitation (Bollard pull) of the ship; use of the anchor installation ship to apply a minimum setting load to two diametrically opposed anchors in combination with the use of a tensioning barge to apply full test loads to the two anchors; testing a single anchor by connecting a deadman anchor to the bow pad eye of the anchor installation ship and applying load to the anchor using a combination of the ship's Bollard pull and its towing winch pull capacity; and/or using a ratchet tensioning system which utilizes the pulling capacity of the installation ship's towing winch. All of the foregoing techniques are considered to be unsatisfactory for one or more reasons, including excessive costs, limitations as to depth, and limitations as to capacity.

The present invention comprises an anchor installation vessel and method which overcomes the foregoing and other problems long since associated with the prior art. In accordance with the broader aspects of the invention, an anchor installation vessel is adapted to transport and install at least two of the anchors and the mooring lines associated therewith which form part of the anchor array of a preset mooring system. The vessel is provided with a pair of winches and structure for connecting the winches to two diametrically opposed anchors of the anchor array. In this manner the anchor installation vessel of the present invention is adapted to simultaneously test two anchors by employing the anchors to pre-load each other.

In accordance with more particular aspects of the invention, the rear of the vessel is provided with a pair of transverse rollers and a pair of longitudinal rollers located adjacent to and below the transverse rollers. This allows the mooring lines extending from the anchors to enter the vessel from opposite sides. As load is applied to the mooring lines by the winches the stern of the vessel centers itself both transversely and longitudinally at a center point between the two anchors, and the anchors are tested by employing the winches of the vessel to apply equal and opposite loads thereto.

BRIEF DESCRIPTION OF THE DRAWINGS

A more complete understanding of the present invention may be had by reference to the following Detailed Description when taken in connection with the accompanying Drawings wherein.

DETAILED DESCRIPTION

Figure 1:
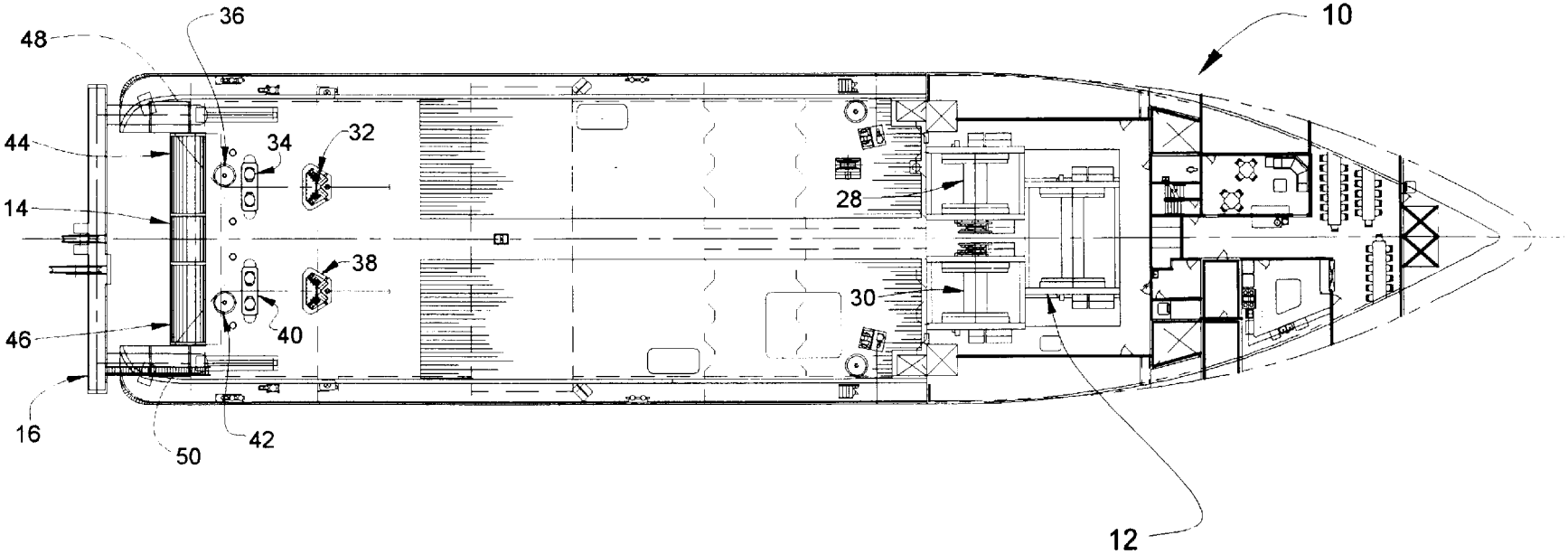
FIG. 1 is a top view of the anchor installation vessel of the present invention illustrating the main deck thereof.

Referring now to the Drawings, and particularly to FIG. 1 thereof, there is shown an anchor installation vessel 10 comprising the preferred embodiment of the invention. The vessel 10 includes a state-of-the-art hull, and is provided with a state-of-the-art propulsion system and a state-of-the-art navigation system. Those skilled in the art will appreciate the fact that the present invention is not limited to use with the vessel illustrated in the Drawings, but is readily adapted for use with various kinds and types of vessels all of which are well known in the art.

The vessel 10 includes a towing/anchor handling winch 12, a center roller 14, and an A-frame 16. The A-frame 16 is located at the stern of the vessel 10, and is used to launch and recover payloads such as anchors, and the like. A traveling gantry crane can be used instead of the A-frame 16, if desired.

Figure 2:
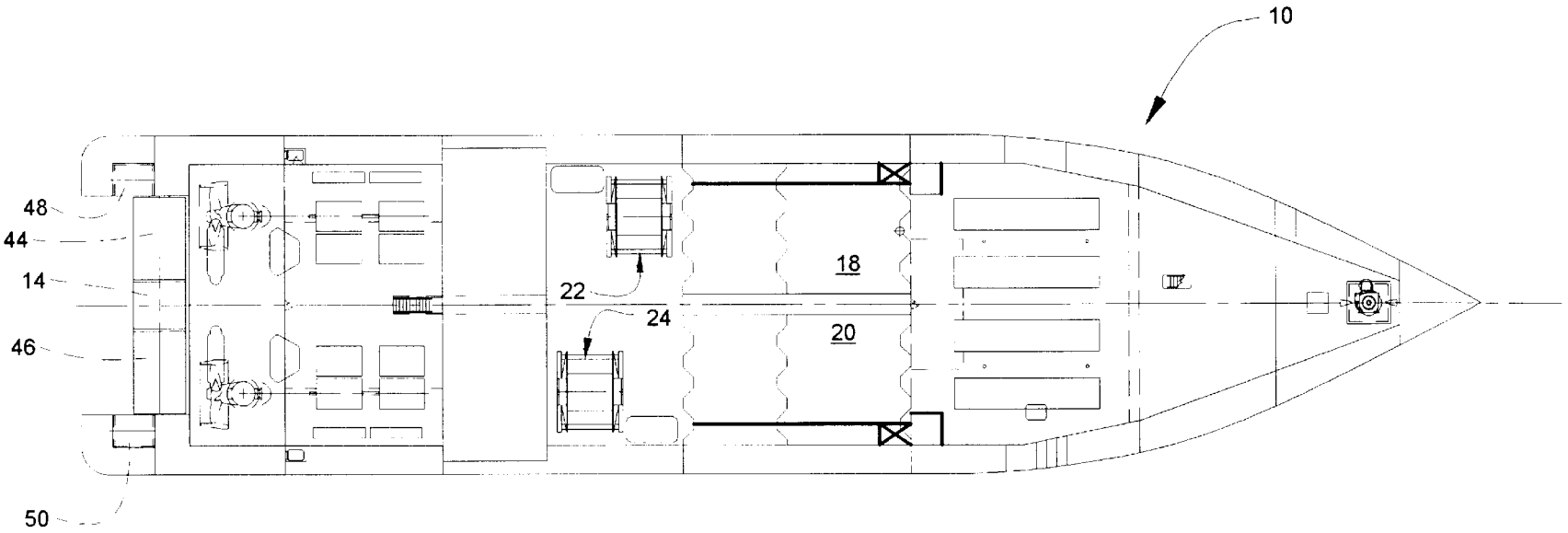
FIG. 2 is a longitudinal sectional view of the vessel of FIG. 1 comprising the hold plan thereof.
Figure 3:
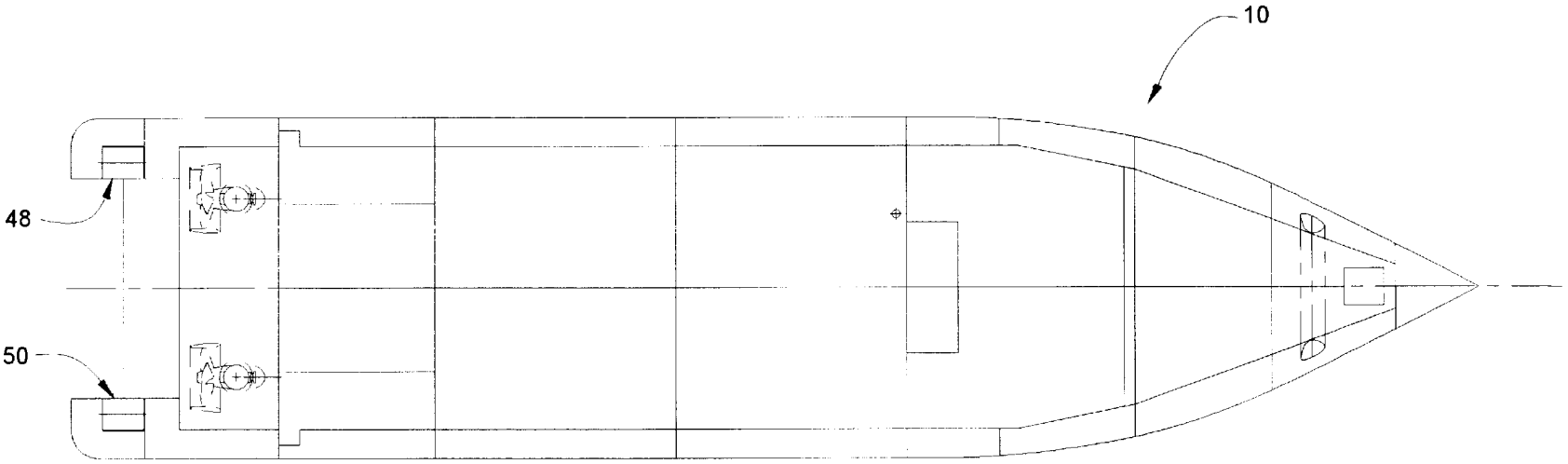
FIG. 3 is a longitudinal sectional view of the vessel of FIG. 1 comprising the innerbottom plan thereof.

Referring particularly to FIG. 2, the vessel 10 is provided with two independent rig chain lockers 18 and 20 and two independent wire storage reels 22 and 24. As will be apparent from a comparison of FIGS. 1 and 2, the lockers 18 and 20 and the reels 22 and 24 are positioned below the main deck 26 of the vessel 10. This arrangement maximizes clear working deck space.

Referring again to FIG. 1, the anchor installation vessel 10 of the present invention is provided with a pair of main winches or drums 28 and 30 mounted in a side-by-side configuration. Each of the drums 28 and 30 is capable of developing sufficient line tension to proof load, i.e., test, high holding power anchors. Thus, each of the drums 28 and 30 is capable of applying a load of 500 short tons.

A mooring line extending from the drum 28 is extended through a shark's jaw 32, through inclined tow pins 34, and around an idler 36. A mooring line extending from the drum 30 passes through a shark's jaw 38, through inclined tow pins 40, and around an idler 42.

Figure 4:
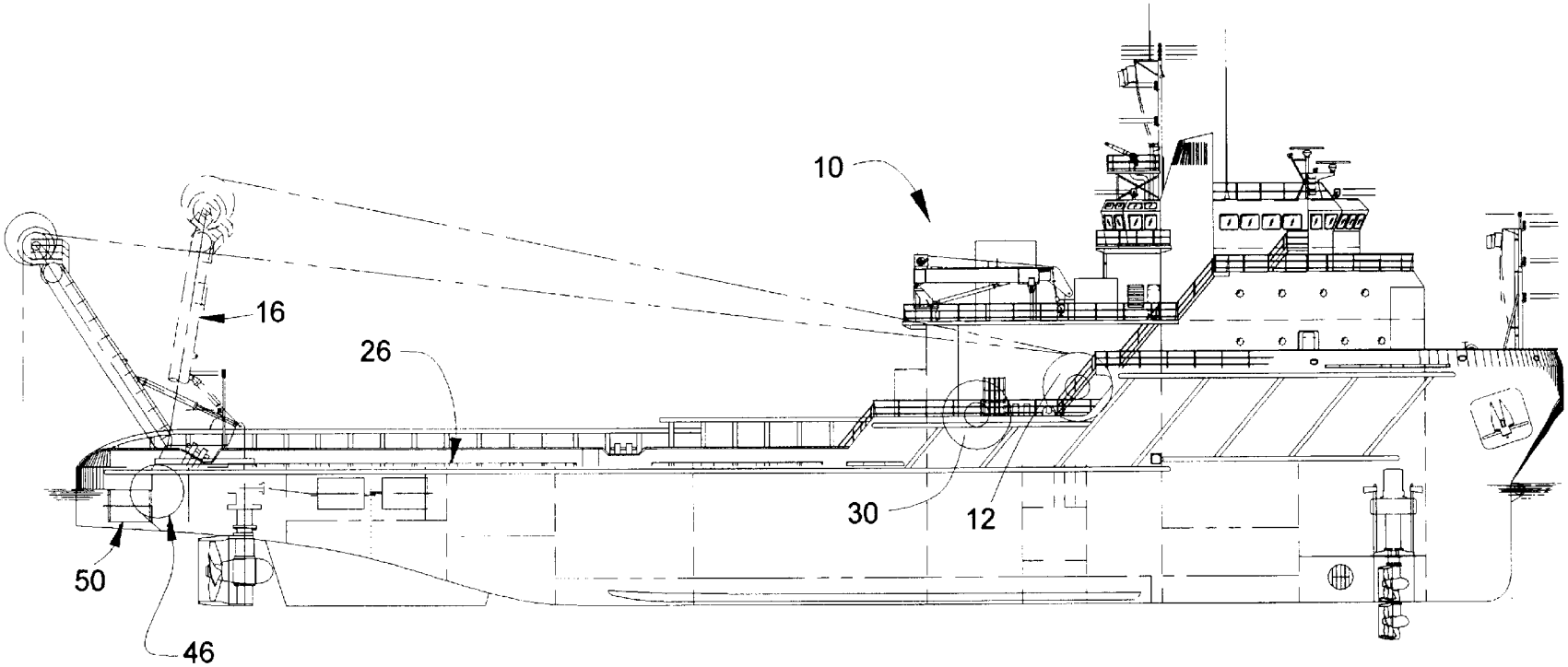
FIG. 4 is a side view of the vessel of FIG. 1.
Figure 5:
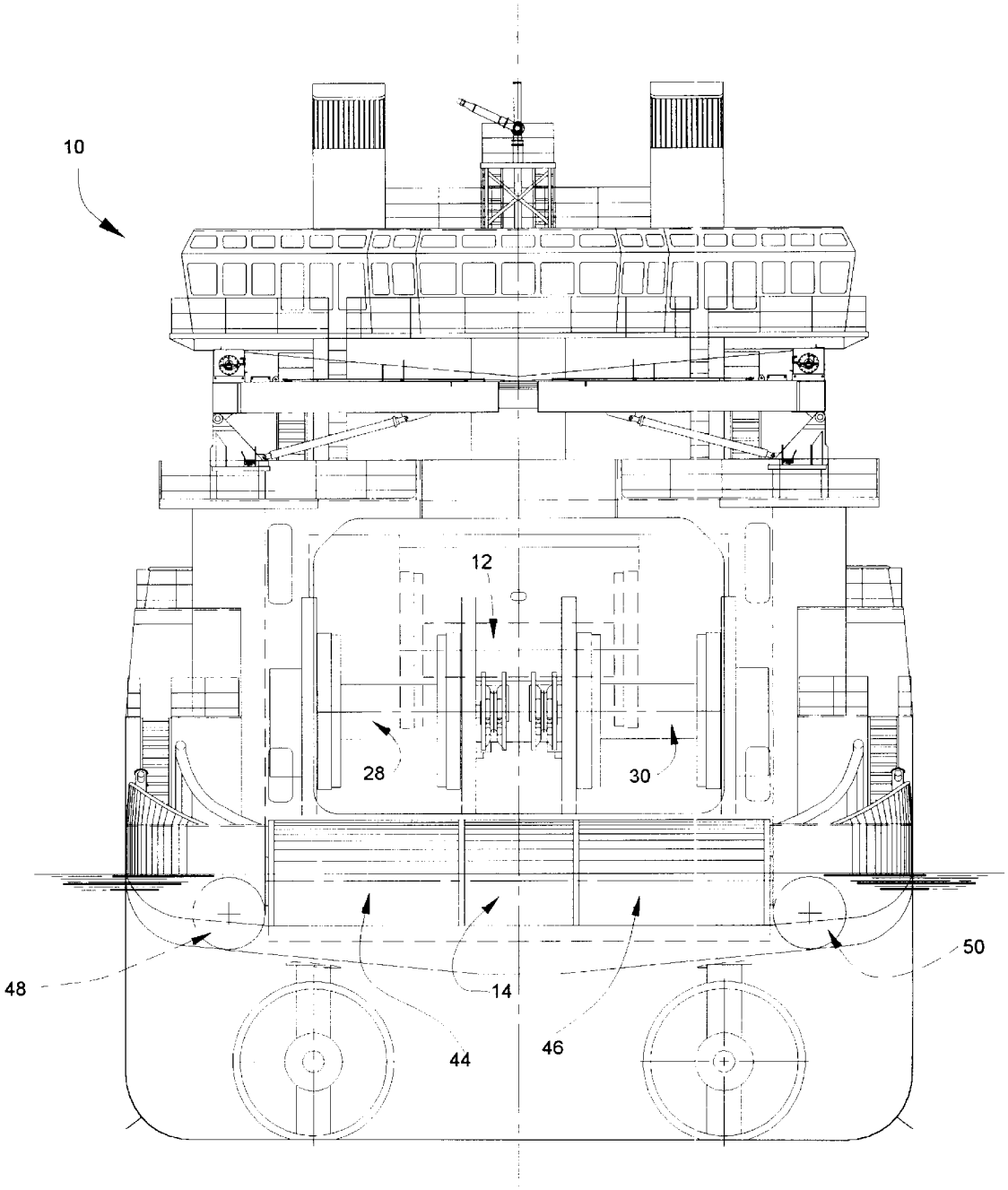
FIG. 5 is an end view of the vessel of FIG. 1.

A pair of transverse rollers 44 and 46 are mounted coaxially with the center roller 14 for rotation about a horizontal axis. As is best shown in FIG. 4, the top of each roller 44 and 46 is tangent with the upper surface of the deck 26. A pair of longitudinal rollers 48 and 50 are mounted adjacent to and below the transverse rollers 44 and 46, respectively, the positional relationship between the transverse roller 44 and the longitudinal roller 48 and between the transverse roller 46 and the longitudinal roller 50 as is further illustrated in FIGS. 4 and 5. The relative positioning of the transverse and longitudinal rollers is selected to prevent pinching of the mooring line between them.

Referring again to FIG. 1, a mooring line extending from the drum 28 passes through the shark's jaw 32, through the tow pins 34, around the idler 36, over the transverse roller 44, under the longitudinal roller 48, and hence outwardly from the side of the vessel 10 in a direction extending substantially perpendicular to the center line thereof. Likewise, a mooring line extending from the drum 30 passes through the shark's jaw 38, through the tow pins 40, around the idler 42, over the transverse roller 46, under the longitudinal roller 50, and hence outwardly from the side of the vessel 10 in a direction extending substantially perpendicularly to the center line thereof. Thus, the two mooring lines extend in opposite directions outwardly from the vessel 10 and ultimately to two diametrically opposed anchors comprising part of an anchor array.

In accordance with the method of the invention, the anchor installation vessel 10 is utilized to install at least two diametrically opposed anchors comprising part of an anchor array. The vessel 10 may be used to install a wide variety of anchor types, including clump anchors, drag embedment anchors, vertically loaded anchors, suction anchors, etc. The anchors are installed in conventional fashion utilizing the winch 12, the center roller 14, the A-frame 16, etc. As each anchor is launched, lowered to the seafloor, and installed by the vessel 10, it carries along with it a mooring line comprising chain from one of the lockers 18 or 20 and/or wire from one of the reels 22 or 24.

Upon completion of the anchor installation process, one of the mooring lines extends under the longitudinal roller 48, over the transverse roller 44, around the idler 36, through the tow pins 34, and through the shark's jaw 32 to the winch or drum 28. Another mooring line extends under the longitudinal roller 50, over the transverse roller 46, around the idler 42, through the tow pins 40, and through the shark's jaw 38 to the winch or drum 30. The drums 28 and 30 are then employed to proof load or test the anchors to assure that they have been installed properly. As tension is applied by the drums 28 and 30 the vessel 10 centers itself both transversely and longitudinally at a point equidistant between the two anchors under test. By means of the present invention the anchors are tested one anchor against the other to assure that both anchors have adequate holding power for mooring operations.

As described hereinabove, the present invention finds utility in connection with the installation of the anchor array of a preset mooring system. However, the invention is not limited to such applications. As will be understood by those skilled in the art, the invention can be used with any opposed anchors regardless of the purpose for which they are installed.

The use of the invention is advantageous over the prior art in several respects. First, anchor testing is accomplished without relying on the propulsion system of the vessel. Second, the use of a second vessel, such as a tensioning barge, is not required in the practice of the present invention. Third, the use of a deadman anchor to secure the testing vessel during testing procedures is not required. Fourth, the use of a ratchet tensioning system and/or other auxiliary equipment is not necessary in the practice of the invention.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

We claim:

1. An anchor installation vessel comprising:

a pair of tensioning winches each having a drum mounted for rotation about a transverse axis;

a pair of longitudinal rollers mounted on opposite sides of the vessel for receiving thereunder mooring lines extending from opposite sides of the vessel to previously installed anchors;

a pair of transverse rollers each mounted adjacent to and above one of the longitudinal rollers for receiving thereover the mooring lines extending under the adjacent longitudinal roller, each pair of longitudinal and transverse rollers for changing the direction of one of the mooring lines from transverse to longitudinal; and guide members for directing the mooring lines from the transverse rollers to the tensioning winches.

2. The anchor installation vessel according to claim 1 wherein the longitudinal rollers and the transverse rollers are positioned at one end of the vessel and wherein the tensioning winches are positioned relatively amidships.

3. The anchor installation vessel according to claim 1 wherein the guide members comprise two sets, each set including an idler for receiving one of the mooring lines from the transverse roller, tow pins, and a shark's jaw.

4. A method of installing anchors and mooring lines comprising a preset mooring system used to moor mobile offshore drilling units and floating production platforms comprising:

installing two anchors of the preset mooring system at diametrically opposed locations comprising a mooring site;

operatively connecting mooring lines of the preset mooring system extending from the installed anchors to a pair of tensioning winches mounted on the anchor installation vessel;

operating the tensioning winches to simultaneously proof load both of the installed anchors of the preset mooring system; and disconnecting the mooring lines of the preset mooring system from the anchors installation vessel so that the anchors and mooring lines comprising the preset mooring system remain at the mooring site following departure therefrom of the anchor installation vessel.

5. The anchor installation method according to claim 4 further including the steps of:

transporting the anchors and the mooring lines of the preset mooring system to the installation site on the installation vessel; and employing the installation vessel to install the anchors of the preset mooring system.

6. The anchor installation method according to claim 4 further characterized by extending the mooring lines of the preset mooring system from the installed anchors to the winches from opposite sides of the installation vessel.

7. A method of installing anchors and mooring lines comprising a preset mooring system used to moor mobile offshore drilling units and floating production platforms comprising:

providing an anchor installation vessel;

transporting at least two anchors of the preset mooring system and at least two mooring lines of the preset mooring system to an anchor installation site on the anchor installation vessel;

employing the anchor installation vessel to install the anchors of the preset mooring system at the site with a mooring line of the preset mooring system extending from each installed anchor to the anchor installation vessel;

providing a pair of tensioning winches on the vessel;

employing the winches to simultaneously proof load the installed anchors of the preset mooring system; and disengaging the mooring lines of the preset mooring system from the anchor installation vessel so that the anchors and the mooring lines of the preset mooring system remain at the anchor installation site following departure of the anchor installation vessel.

8. The anchor installation method according to claim 7 further characterized by directing the mooring lines of the preset mooring system from the installed anchors of the preset mooring system to the winches from opposite sides of the vessel.

9. The anchor installation method according to claim 8 wherein the transporting step is further characterized by transporting the anchors of the preset mooring system on the deck of the vessel and transporting the mooring lines of the preset mooring system beneath the deck of the vessel, and wherein the installation step is further characterized by employing a lifting mechanism mounted on the vessel to launch the anchors from the deck of the vessel.

* * * * *